US009783992B2

(12) United States Patent
Bombino et al.

(10) Patent No.: US 9,783,992 B2
(45) Date of Patent: Oct. 10, 2017

(54) THERMALLY INSULATIVE SPACER AND METHODS INVOLVING USE OF SAME

(71) Applicant: CASCADIA FIBERGLASS INC., Vancouver (CA)

(72) Inventors: Roberto Bombino, Seattle, WA (US); Kevin Joseph Michael Ganzert, Coquitlam (CA); Warren Samuel Knowles, Coquitlam (CA); Edward Peter Thiessen, Coquitlam (CA); Michael James Wilson, North Saanich (CA)

(73) Assignee: Cascadia Fiberglass Inc., Vancouver, BC ( * ) Notice: Subject to any disclaimer, the term of this patent is extended or adjusted under 35 U.S.C. 154(b) by 0 days.

(21) Appl. No.: 15/340,863

(22) Filed: Nov. 1, 2016

(65) Prior Publication Data

US 2017/0051512 A1 Feb. 23, 2017

Related U.S. Application Data

(63) Continuation of application No. 13/357,799, filed on Jan. 25, 2012, now Pat. No. 9,499,974.

(30) Foreign Application Priority Data

Jan. 5, 2012 (CA) ..... 2763058

(51) Int. Cl.
*E04F 13/08* (2006.01)
*E04B 2/58* (2006.01)
(Continued)

(52) U.S. Cl.
CPC ..... *E04F 13/0805* (2013.01); *E04B 1/40* (2013.01); *E04B 1/7612* (2013.01);
(Continued)

(58) Field of Classification Search
CPC ... E04D 13/1625; E04D 13/1637; E04B 2/58; E04B 2/7412; E04B 1/7612;
(Continued)

(56) References Cited

U.S. PATENT DOCUMENTS 2,298,989 A 10/1942 Underwood
3,045,293 A 7/1962 Potchen
(Continued)

FOREIGN PATENT DOCUMENTS

CA 2237793 C 5/1997
EP 107054 A1 5/1984
(Continued)

*Primary Examiner* — Robert Canfield
*Assistant Examiner* — Matthew Gitlin
(74) *Attorney, Agent, or Firm* — Oyen Wiggs Green & Mutala LLP

(57) ABSTRACT

A spacer for use in spacing a cladding component from a building component has a support member, a base spaced apart from the support member, the base having a contact surface facing away from the support member, a web connected between the support member and the base, and a guide configured to locate the cladding component on the support member. A plurality of the spacers can be used by resiliently deforming them to accommodate and retain by restorative bias force a corresponding plurality of portions of the cladding component. Thereafter, the spacers are secured to the building component.

15 Claims, 13 Drawing Sheets

(51) Int. Cl.

| | |
|---|---|
| ***E04B 2/74*** | (2006.01) |
| ***E04B 1/76*** | (2006.01) |
| ***E04B 1/41*** | (2006.01) |
| *E04B 1/38* | (2006.01) |

(52) U.S. Cl.
CPC ..... *E04B 1/7616* (2013.01); *E04B 2/58* (2013.01); *E04B 2/7412* (2013.01); *E04B 1/7608* (2013.01); *E04B 1/7629* (2013.01); *E04B 2001/405* (2013.01)

(58) Field of Classification Search
CPC ..... E04B 1/7616; E04F 13/0805; E04F 13/0803; E04F 21/0092; F16B 2/22; F16B 5/0028; F16L 59/12
USPC ..... 52/483.1, 489.1, 489.2, 474, 407.3, 52/506.05, 508, 512
See application file for complete search history.

(56) References Cited

U.S. PATENT DOCUMENTS 3,271,920 A 9/1966 Downing, Jr.
3,521,419 A * 7/1970 Fornells ..... E04B 9/26 52/386
3,574,985 A 4/1971 Pierce
3,712,015 A 1/1973 Nelson
3,839,839 A 10/1974 Tillisch et al.
3,868,802 A 3/1975 Schubach
4,047,355 A 9/1977 Knorr
4,152,878 A * 5/1979 Balinski ..... E04B 1/941 52/481.1
4,333,290 A 6/1982 Koberstein
4,399,642 A 8/1983 Bard et al.
4,435,936 A 3/1984 Rutkowski
4,502,256 A * 3/1985 Hahn ..... E04D 5/143 24/459
4,505,085 A 3/1985 Oliver et al.
4,593,511 A 6/1986 Hakasaari
4,596,099 A 6/1986 Kaminaga
4,603,528 A * 8/1986 Sigerist ..... E04F 13/0803 52/464
4,649,689 A 3/1987 Everman et al.
4,742,665 A 5/1988 Baierl
4,873,808 A 10/1989 Heisey, Jr. et al.
4,894,970 A 1/1990 Lebraut
4,936,065 A 6/1990 Hutchinson
5,009,051 A 4/1991 Trezza
5,062,250 A 11/1991 Buzzella
5,076,035 A * 12/1991 Wright ..... E04B 2/96 52/464
5,177,922 A * 1/1993 Ovaert ..... E04D 3/3603 411/383
5,226,274 A 7/1993 Sommerstein
5,228,257 A 7/1993 Bowersox et al.
5,245,808 A 9/1993 Grunewald et al.
5,355,645 A 10/1994 Farag
5,408,796 A 4/1995 Hashimoto et al.
5,592,795 A * 1/1997 Rinehart ..... E04B 2/967 52/204.591
6,158,915 A 12/2000 Kise
6,189,269 B1 2/2001 De Zen
6,202,377 B1 * 3/2001 Krieger ..... E04F 13/0812 52/489.1
6,289,646 B1 9/2001 Watanabe
6,367,219 B1 4/2002 Quinlan
6,385,935 B2 * 5/2002 Lippy ..... E04B 9/22 411/396
6,421,972 B1 7/2002 Dalphond et al.
6,591,557 B1 7/2003 Thomsen et al.
6,857,237 B1 2/2005 Dalphond et al.
6,886,790 B2 5/2005 Soyris
6,962,025 B1 * 11/2005 Hill ..... C23C 4/00 148/525
6,993,875 B2 2/2006 Rudduck
7,043,884 B2 5/2006 Moreno
7,562,504 B2 * 7/2009 Herbst ..... E04F 13/0889 52/235
7,596,911 B2 10/2009 Turco
7,712,273 B2 5/2010 Panasik et al.
7,810,294 B2 10/2010 Maley et al.
8,127,507 B1 * 3/2012 Bilge ..... E04F 13/0814 52/235
8,166,716 B2 * 5/2012 Macdonald ..... E04F 13/0826 52/235
8,307,607 B2 * 11/2012 Conterno ..... E04F 10/02 52/762
8,316,609 B2 * 11/2012 Ben-Zvi ..... E04C 2/543 52/459
8,418,983 B2 4/2013 Hartelius et al.
8,418,984 B2 4/2013 Hartelius et al.
9,051,741 B2 * 6/2015 Bilge ..... E04F 13/07
9,499,974 B2 11/2016 Bombino
2003/0172607 A1 9/2003 Brandes
2004/0128930 A1 7/2004 Ohnishi
2006/0102883 A1 5/2006 Troutman et al.
2006/0201084 A1 9/2006 Arias
2006/0254167 A1 11/2006 Antonic
2007/0068111 A1 * 3/2007 Buntain ..... E04B 1/7612 52/699
2007/0163188 A1 * 7/2007 Price ..... E02D 27/01 52/169.12
2007/0193143 A1 8/2007 Antonic
2007/0199261 A1 8/2007 Lang
2009/0145071 A1 * 6/2009 Radford ..... E04F 13/0805 52/506.08
2010/0095629 A1 4/2010 Taylor
2010/0199585 A1 8/2010 Stevens et al.
2010/0242397 A1 * 9/2010 Givoni ..... E04C 2/543 52/588.1
2010/0251647 A1 10/2010 Enns
2010/0287862 A1 11/2010 Goldberg et al.
2011/0072744 A1 * 3/2011 Maley ..... E04B 9/006 52/220.1
2012/0117901 A1 5/2012 Loyd
2013/0125492 A1 5/2013 Molek et al.
2014/0202094 A1 7/2014 Bilge
2014/0260043 A1 9/2014 Cottier
2015/0292215 A1 * 10/2015 Bilge ..... E04F 13/083 52/506.05

FOREIGN PATENT DOCUMENTS

EP 0476524 A1 3/1992
EP 2141070 A1 6/2010
GB 2084229 A 4/1982
WO 8601242 A1 2/1986
WO 9824992 A1 6/1998
WO 2011044696 A1 4/2011

* cited by examiner

THERMALLY INSULATIVE SPACER AND METHODS INVOLVING USE OF SAME

REFERENCE TO RELATED APPLICATIONS

This application is a continuation of U.S. patent application Ser. No. 13/357,799 filed 25 Jan. 2012, which claims priority to Canadian patent application No. 2763058 filed 5 Jan. 2012. Each of the foregoing applications is hereby incorporated by reference herein in its entirety.

TECHNICAL FIELD

The invention provides thermally insulative spacers useful for supporting cladding components on a building or building component. Particular embodiments provide spacers made of various low conductivity materials, such as fibre reinforced polymers.

BACKGROUND

In constructing buildings, it is common to attach cladding components (e.g., girts, purlins, panels, roofing, etc.) to supportive building components (e.g., steel stud wall studs, concrete or masonry walls, floors, roofs, and other back-up supports). In many applications, it is preferable to provide space between cladding components and the building components for insulation as well as to achieve other performance characteristics including durability. This is typically done by attaching supporting cladding components with spacers or other supports to a back-up structure.

FIG. 1 is a perspective view of an exterior wall assembly 10 that illustrates use of prior art spacers to connect cladding components to supporting building components. Assembly 10 comprises a wall 12 formed by interior finish 14 such as a drywall board, a C-shaped steel stud 16, and an exterior wall panel or sheathing 18. A moisture barrier 20 may cover exterior wall sheathing 18. A galvanized steel spacer 22 is attached to steel stud 16 by screws 22A that pass through barrier 20, exterior wall sheathing 18 and at least a portion of stud 16. Spacer 22 shown in FIG. 1 is one of a plurality of like steel spacers attached to wall 12 in spaced apart, vertically aligned relation. Alternatively, continuous girts are also used to achieve this function. Spacer (or "clip") 22 connects cladding components 24, which may consist of supporting cladding framework such as elongate vertical steel girt 26, and exterior finish 30 (e.g., stucco, metal panels, etc.), to wall 12. Girt 26 is attached by screws 24A to spacer 22. Insulation 32 may be provided in the space between wall 12 and cladding components (24, 26, and 30), and an air cavity and/or moisture drainage cavity 28 may be provided.

In assembly 10, steel spacer 22 must have sufficient strength and rigidity to support the cladding under the various loads it faces (gravity, wind, seismic, etc.). Steel or other metal clips are typically used due to their strength, stiffness, and fire resistance characteristics. Steel is also relatively inexpensive, durable and adaptable compared to other similar options such as aluminum and other metals.

A problem with wall assembly 10 is that spacer 22, being made of steel, is thermally conductive and provides a thermal bridge from cladding components 24 (and in some cases 26 and 30) to wall 12. Moreover, since spacer 22 is adjacent to steel stud 16, which is also thermally conductive, spacer 22 and steel stud 16 together provide a thermal bridge from cladding components 24 to interior wall panel 14. Since insulation 32 is provided around spacer 22 (and in some cases around the steel stud 16), spacer 22 (and steel stud 16) acts an insulation bypass. As a result, it is difficult for wall assembly 10 to achieve the high levels of insulative performance demanded by modern construction standards without unduly increasing the depth of spacer 22, steel stud 16, and/or insulation 32.

The foregoing examples of the related art and limitations related thereto are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

At its simplest, the invention is a spacer for use in spacing a building cladding component from a building component, the spacer comprising a support member; a base spaced apart from the support member, the base having a contact surface facing away from the support member; a web connected between the support member and the base; and a guide configured to locate the cladding component on the support member. In another aspect, an assembly is provided for use in spacing a building component and a cladding component, the assembly comprising a spacer having: a support member, a base spaced apart from the support member, the base having a contact surface facing away from the support member, and a web connected between the support member and the base; and a guide adjacent the support member of the spacer, the guide configured to locate the cladding component relative to the spacer, wherein the support member, base and web and are features of a pultruded profile section. There is also provided a method for spacing a cladding component from a building component, the method comprising deforming each of a plurality of spacers to accommodate and retain by restorative bias force a corresponding plurality of portions of the cladding component; and securing the spacers to the building component.

In addition to the exemplary aspects and embodiments described above, further aspects and embodiments will become apparent by reference to the drawings and by study of the following detailed descriptions.

BRIEF DESCRIPTION OF DRAWINGS

The accompanying drawings show non-limiting example embodiments.

DESCRIPTION

Figure 1:
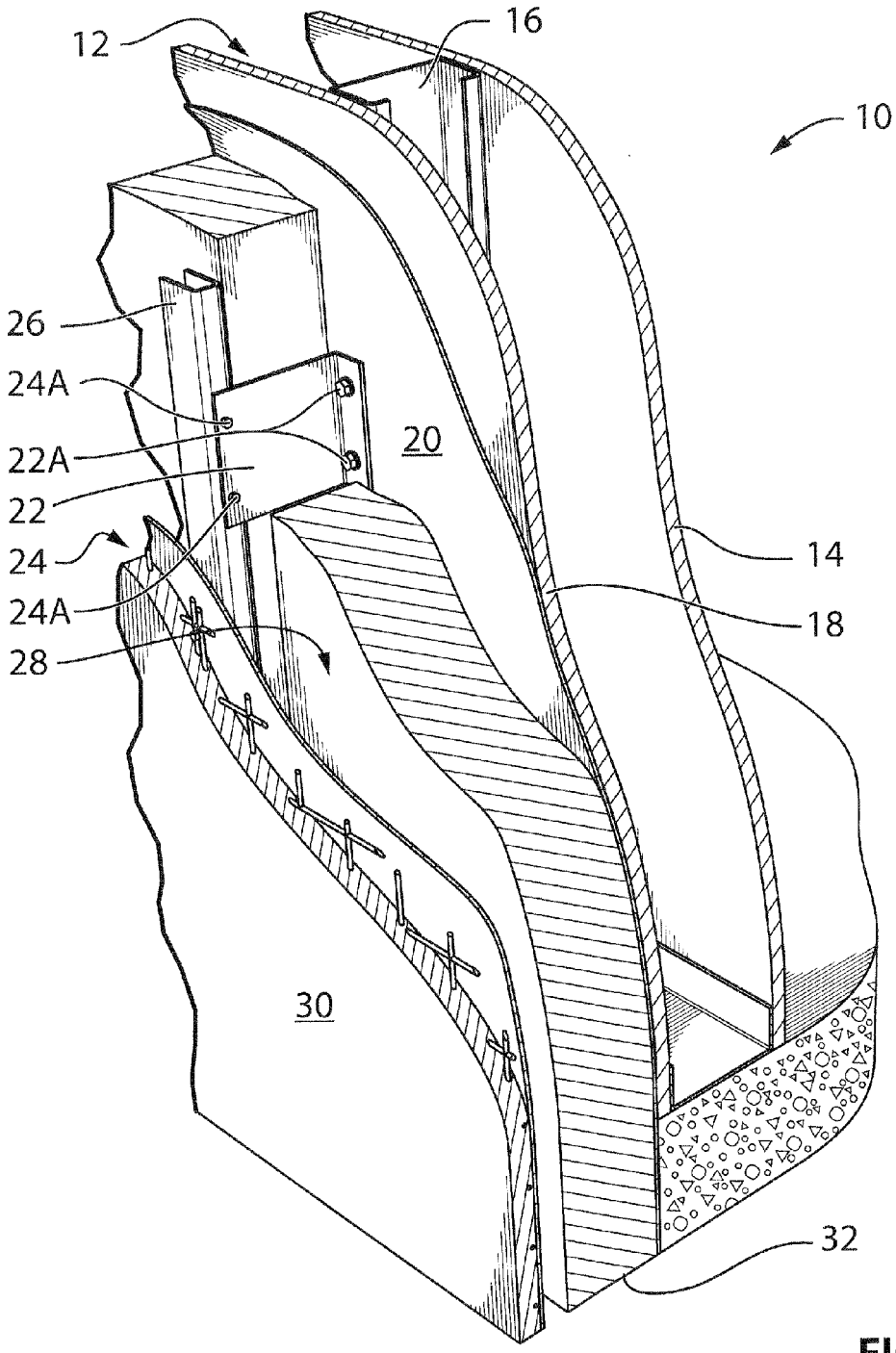
PRIOR ART FIG. 1
FIG. 1 is a perspective view of a prior art wall assembly.

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Some building standards specify minimum prescriptive effective insulation R-values for wall assemblies. For example, the American Society Heating, Refrigerating and Air-Conditioning Engineers (ASHRAE) standard 90.1 2007 specifies a minimum prescriptive R-value of R-13.0+R-7.5 continuous insulation (approximately an effective R-15.6 $ft^2$ h ° F./Btu) for a steel-framed wall assembly within Climate zone 5 (in which resides the Lower Mainland and Vancouver Island, British Columbia, Canada). It is desirable to achieve minimum prescriptive R-values specified by standards for many reasons, including that buildings that achieve these values may be maintained at comfortable interior temperatures with less energy consumption, and may be marketed as being energy efficient.

One way to increase the R-value of a wall assembly is to increase the amount of insulation provided in the wall assembly. However, there are disadvantages associated with increasing the amount of insulation in a wall assembly, including increased cost (for more or better insulation as well as other components such as deeper spacers or flashings), increased wall thickness, increased wall mass, loss of useable floor space, and the like, for example. Thermal simulations performed at the direction of the inventors have shown that increasing the thickness of insulation in wall assemblies comprising thermally conductive spacers improves thermal performance with diminishing returns. Table I is a summary of effective R-values estimates determined by thermal simulations for walls constructed in the manner of assembly 10 having various depths of insulation 32 and correspondingly dimensioned steel spacers 22.

TABLE I

| Thermal performance of wall assembly 10 | |
|---|---|
| Mineral Fiber Insulation Thickness | Overall Effective Insulation R-value |
| 3½ inches | 11.6 |
| 4 inches | 12.4 |
| 6 inches | 15.6 |

The simulations were performed using the HEAT 3D™ three dimensional finite-element thermal analysis program. In the simulation, spacers 22 were specified as 16 gauge galvanized steel, girt 26 was 20 gauge steel C-girt, and insulation was specified as semi-rigid mineral fiber insulation boards (R-4.2 per inch). Spacers 22 were spaced 16" horizontally and 24" vertically. Fastening of spacers 22 between cladding 24 and wall 12 was specified as Leyland DT-2000 coated ¼" thread diameter steel screws. Exterior facing 30 was specified as ¾" stucco cladding. Material properties were taken from the HEAT 3D™ database and ASHRAE wintertime design conditions were used for the boundary conditions in the model.

Figure 2:
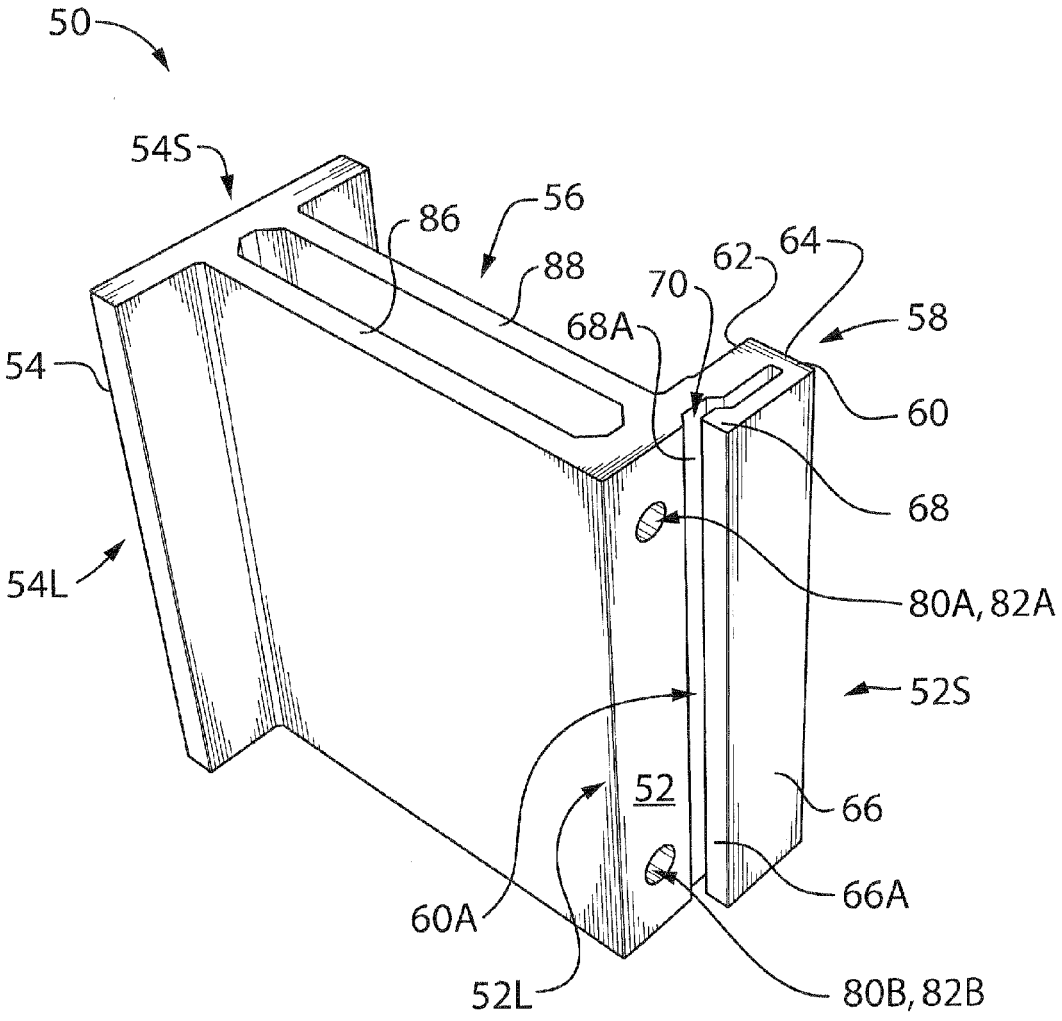
FIG. 2 is a perspective view of a spacer according to an example embodiment.
Figure 3:
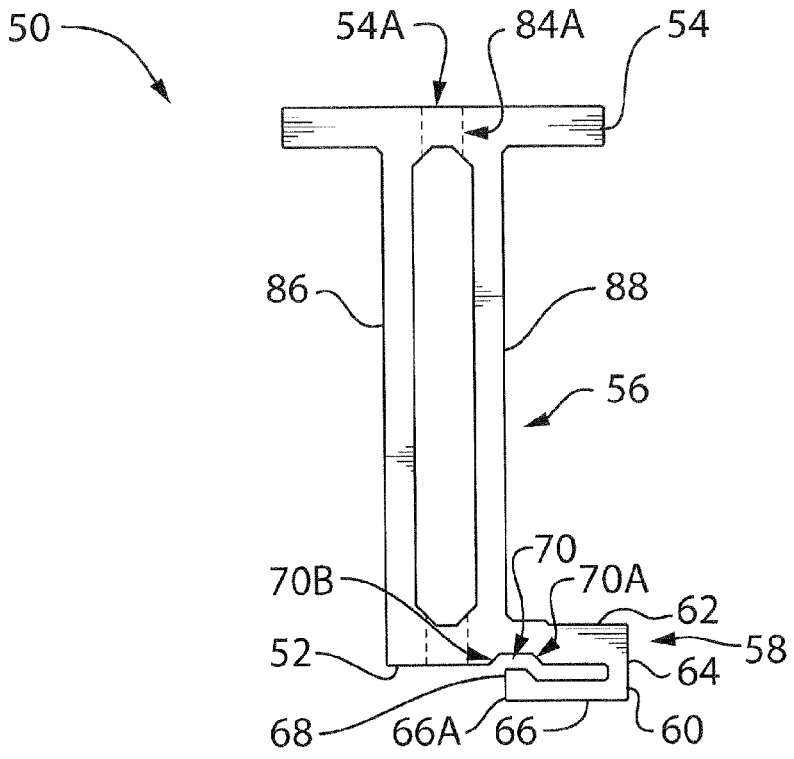
FIG. 3 is a top plan view of the spacer shown in FIG. 2.
Figure 4:
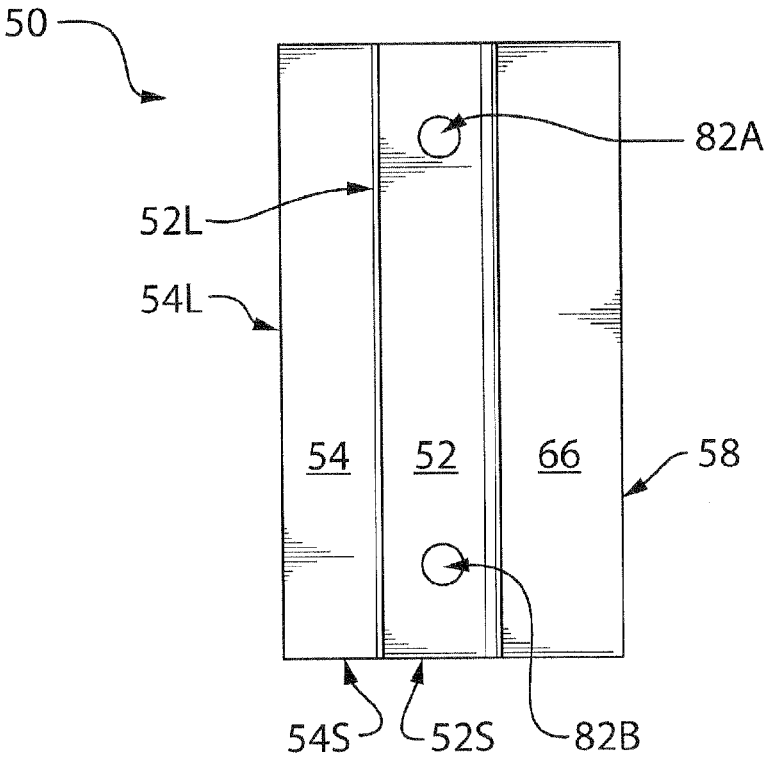
FIG. 4 is a front elevation view of the spacer shown in FIG. 2.

FIGS. 2, 3 and 4 show different views of a spacer 50 according to an example embodiment. More particularly:

FIG. 2 is a perspective view of spacer 50;

FIG. 3 is a top plan view of spacer 50; and

FIG. 4 is a front elevation view of spacer 50.

Spacer 50 may be used for spacing a cladding component from a building component. Spacer 50 is made at least in part from thermally insulative material. In the illustrated example embodiment, spacer 50 comprises a pultruded profile section of a fibre reinforced polymer, namely fibreglass.

Spacer 50 comprises a support member 52. Spacer 50 also comprises a base 54 spaced apart from support member 52. Base 54 and support member 52 are connected by a web 56. In the illustrated embodiment, spacer 50 is generally elongate (i.e. has long and short sides when seen as in FIG. 4), though this is not necessary. In the illustrated embodiment, support member 52 and base 54 are generally rectangular. For convenience, the description may refer to long sides 52L and 54L of support member 52 and base 54, respectively, and to short sides 52S and 54S of support member 52 and base 54, respectively. In some embodiments, one or both of support member 52 and base 54 may be non-rectangular.

Base 54 has a contact surface 54A facing away from support member 52. Support member 52 and contact surface 54A are generally parallel. In the illustrated embodiment, contact surface 54A comprises a plane surface. Base 54 may comprise a differently configured contact surface. For example, a contact surface may comprise two or more spaced apart contact surfaces, a flat annular surface, or the like.

Spacer 50 comprises a guide 58. Guide 58 is configured to locate a cladding component on support member 52. In the illustrated embodiment, guide 58 comprises a U-shaped flexural member 60 adjacent to support member 52. A first flange 62 of flexural member 60 extends along one of long sides 52L of support member 52. First flange 62 is generally parallel to support member 52, such that a flat portion of a cladding component can rest stably on both support member 52 and first flange 62. A flexure bearing 64 located along first flange 62 opposite to support member 52 joins first flange 62 to a second flange 66 of flexural member 60. Flexure bearing 64 pivotally couples first flange 62 and second flange 66 to one another. Flexure bearing 64 provides the base of U-shaped flexural member 60.

Flexure bearing 64 provides a stop which may be used to locate a cladding component over support member 52. For example, a cladding component may be located on support member 52 by inserting the component into the mouth 60A of flexural member 60 and abutting an edge of the component with flexure bearing 64. In the illustrated embodiment, the stop provided by flexure bearing 64 is generally parallel to long sides 52L of support member 52.

It will be appreciated that guide 58 may have other configurations suitable for locating a cladding component on support member 52. For example, guide 58 need not comprise second flange 66 in order to be configured to locate a cladding component on support member 52. In some embodiments, guide 58 comprises one or more projections on or adjacent support member 52 for locating a cladding component by abutment therewith or by registration with corresponding recesses or apertures defined on or through support member 52.

In the illustrated embodiment, flexural member 60 is configured to retain a cladding component against support member 52. In particular, second flange 66 of flexural member 60 is configured to urge a cladding component against support member 52. In the illustrated embodiment, free end 66A of second flange 66 is resiliently displaceable away from support member 52 in direction generally perpendicular to contact surface 54A of base 54. When free end 66A is displaced from its nominal position, flexure bearing 64 and/or second flange 66 generates a restorative bias force, which tends to urge free end 66A toward support member 52.

Free end 66A of second flange 66 comprises a projection 68 that extends toward first flange 62. In the illustrated embodiment, projection 68 extends across free end 66A generally parallel to the long sides 52L of support member 52. Projection 68 is nominally located such that a cladding component to be retained against support member 52 cannot be inserted into mouth 60A of flexural member 60 while the component is stably supported by support member 52. In the illustrated embodiment, projection 68 is nominally spaced apart from the plane of support member 52 by less than the thickness of the cladding component to be retained against support member 52.

In order for the cladding component to be inserted into flexural member 60, projection 68 must be displaced away from support surface 52. Flexural member 60 has two features that facilitate this. First, the outward edge 68A of projection 68, which is opposed to the plane of support member 52 and distal from flexure bearing 64 is bevelled. This may encourage a projection 68 to ride over the leading edge of a cladding component inserted into mouth 60A, and thereby be displaced from its nominal position.

Second, a recess 70 defined on first flange 62 opposite projection 68 permits a cladding component to be inserted at an angle between projection 68 and first flange 62, and used as a lever to displace projection 68 away from support member 52. In the illustrated embodiment, recess 70 spans projection 68. More particularly, the inward edge 70A (proximate to flexure bearing 64) of recess 70 is closer to flexure bearing 64 than projection 68, and the outward edge 70B (which is distal to flexure bearing 64) of recess 70 is further from flexure bearing 64 than projection 68. Edges 70A and 70B of recess 70 are smoothly bevelled.

Figure 5C:
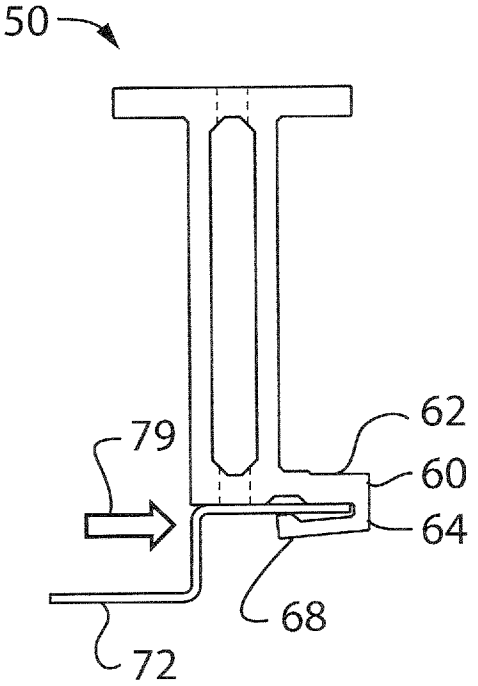
FIGS. 5A, 5B and 5C show a sequence by which a cladding component may be mated with the spacer shown in FIG. 2.
Figure 5B:
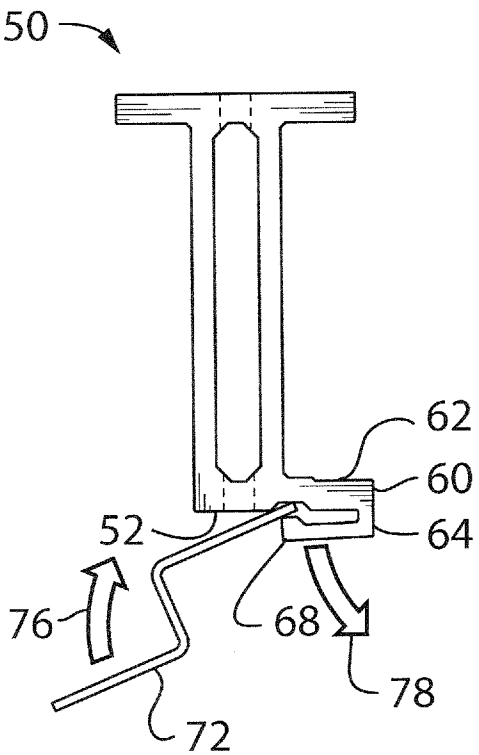
Figure 5A:
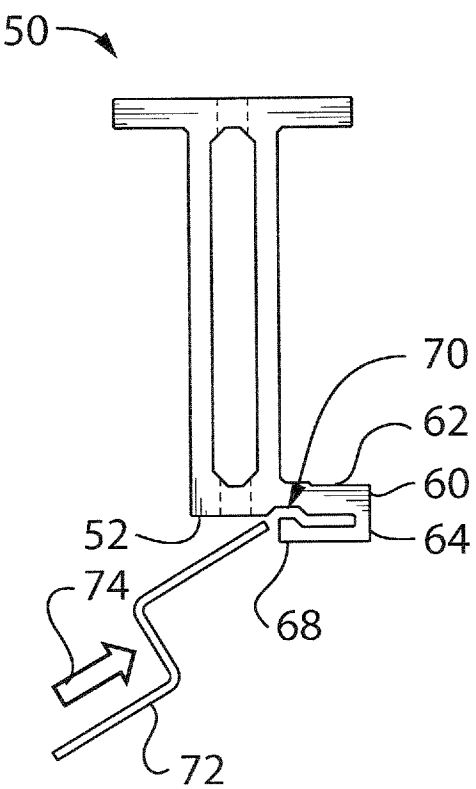

FIGS. 5A, 5B and 5C illustrate how recess 70 facilitates insertion of a cladding component into flexural member 60. FIG. 5A shows a Z-girt 72 inclined with respect to support member 52 and adjacent to projection 68. In FIG. 5A, arrow 74 indicates a direction along which Z-girt 72 may be moved for insertion into mouth 60A of flexural member 60. FIG. 5B shows the leading edge of Z-girt 72 inserted into recess 70 between first flange 62 and projection 68. Arrow 76 in FIG. 5B indicates a direction in which Z-girt 72 may be rotated about outward edge 70B of recess 70 to displace projection 68 in the direction away from support member 52, which direction is indicated by arrow 78. FIG. 5C shows Z-girt 72 installed in flexural member 60. In FIG. 5C, projection 68 is biased by the restorative deformation force of flexure bearing 64 and/or second flange 66 to retain Z-girt 72 against support member 52. Arrow 79 indicates a direction in which Z-girt 72 may be moved so that its leading edge abuts flexure bearing 64 as shown in FIG. 5C.

In the illustrated embodiment, web 56 comprises two generally planar rigid walls 86 and 88. Walls 86 and 88 extend between support member 52 and base 54 in a direction generally normal to support surface 52 and contact surface 54A. Walls 86 and 88 meet support member 52 at opposite ones of its long sides 52L, and are inwardly spaced from the long sides 54L of base 54. When walls 86 and 88 are oriented vertically, the force of gravity on cladding component located on support member 52 by guide 58 manifests as shear stress in walls 86 and 88. The walls 86 and 88 act as webs to efficiently transfer the shear and compressive loads exerted by the cladding, back to the base 54. The fasteners used in conjunction with the spacer transfer the tensile loads. Inclusion of flange 62 and base 54 make the spacer an efficient shape to resist flexural loads imposed by the cladding, and distribute the load over a greater area of the supporting back-up wall 92. The length of the spacer can be readily adjusted to support a variety of different loads with the incorporation of this basic I shape oriented in the direction of the vertical gravity loads (but could be oriented in any direction).

The parallel, spaced apart arrangement of walls 86 and 88 provides torsional rigidity, which resists twisting of support member 52 relative to base 54 about axes generally normal to support member 52 and contact surface 54A. Torsional rigidity of web 56 may be important where a cladding member may transmit torsional forces to support member 52 as a lever.

The rigid connection of walls 86 and 88 to support member 52 and base 54, combined with the parallel spaced apart arrangement of walls 86 and 88 resists bending of walls about axes generally parallel to the long sides 52L of support member 52, since forces that would cause such bending manifest as compression in one wall and tension in the other. This resistance to bending may be important where cladding components connected to spacer 50 are subject to forces generally normal to walls 86 and 88, such as may be caused by wind.

Two fastener paths 80A and 80B (referred to herein collectively as fastener paths 80) are defined through spacer 50. Fastener paths 80 are perpendicular to both support member 52 and contact surface 54A of base 54. Fastener paths 80 pass between walls 86 and 88. In the illustrated embodiment, fastener path 80A comprises a first aperture 82A defined through support member 52 adjacent one of its short sides 52S and a second aperture 84A defined through base 54 adjacent one of its short sides 54S. Fastener path 80B comprises a first aperture 82B defined through support member 52 adjacent the other of its short sides 52S and a second aperture (not visible in the drawings) defined through base 54 adjacent the other of its short sides 54S. Fastener paths 80 may be used for installing penetrating fasteners through spacer 50 to secure spacer 50 to a building component.

Guide 58 may be configured to locate a cladding component so that it is intersected by fastener paths 80. For example, in the illustrated embodiment, guide 58 is configured to locate Z-girt 72 on support member 52 over first apertures 82A and 82B. Cladding components may be provided with apertures that register with fastener paths 80 when located on support member 52 by guide 58. This may enable spacer 50 and a cladding component retained therein to be simultaneously secured to a building component with penetrating fastener.

In a non-limiting example embodiment, the dimensions of spacer 50 are as follows:

- long sides 52L of spacer 52 and 54L of base 54 are 4";
- support member 52 and base 54 are each ¼" thick;
- walls 86 and 88 are each 3/16" thick;
- the distance between walls 86 and 88 is ⅜";
- the distance from contact surface 54A to the opposite facing face of support member 52 is 3½";
- first flange is ¼" thick;
- second flange is ⅛" thick;
- first flange 62 and second flange 66 are spaced apart by ⅛";
- projection 68 and recess 70 are 1/16" deep; and
- apertures 82A, 82B, 84A and the second aperture in base 54 not visible in the drawings are centered ½" inward of the proximate long sides of the bodies in which they are defined.

In this embodiment, the features of flexural member 60 are dimensioned to accommodate a 16 gauge steel cladding component.

Figure 6:
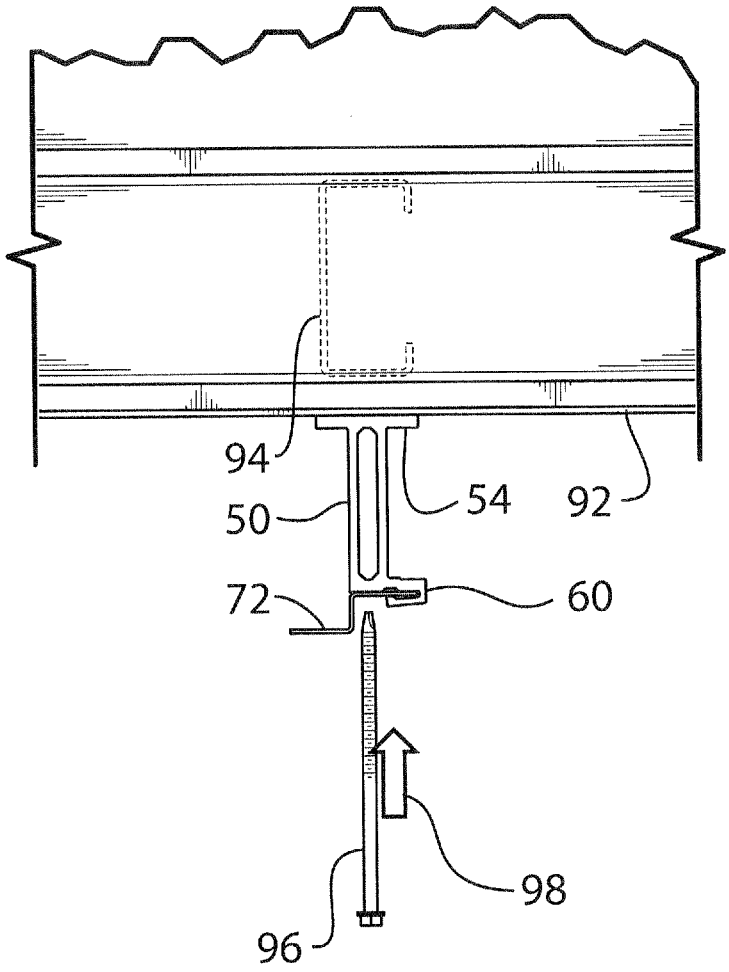
FIG. 6 is a top plan view of a spacer and cladding component assembly according to an example embodiment arranged for securement to a building component.
Figure 7:
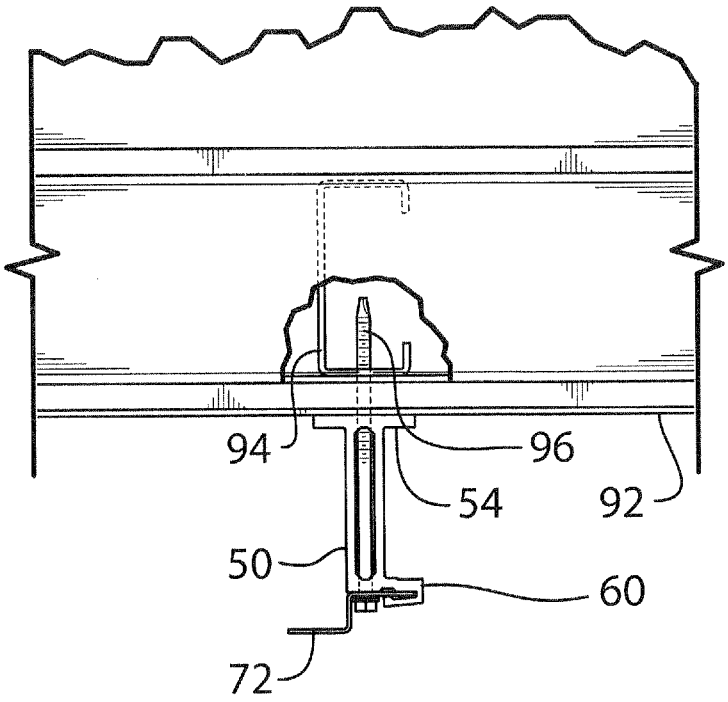
FIG. 7 is a top plan view of the assembly shown in FIG. 6 secured to the building component.
Figure 8:
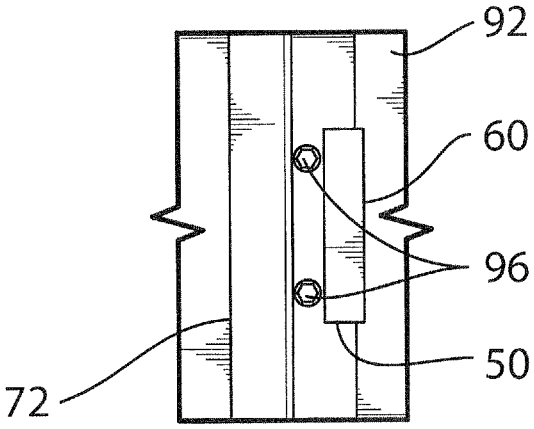
FIG. 8 is a front elevation view of the assembly shown in FIG. 6 secured to the building component.

FIGS. 6, 7 and 8 illustrate an example installation of spacer 50 and Z-girt 72. FIG. 6 is a top plan view showing Z-girt 72 assembled with spacer 50. As previously shown in FIG. 5C, Z-girt 72 is retained against support member 52 by flexural member 60. Contact surface 54A of base 54 is placed against the outside of a building wall 92 in alignment with a C-channel steel stud 94. A penetrating fastener, namely self-tapping lag screw 96, is inserted through an aperture defined in Z-girt 72 and along fastener path 80 in the direction shown by arrow 98. FIG. 7 is a top plan view showing screw 96 engaged with the outer panel of wall 92 and C-channel stud 94 to secure spacer 50 and girt 72 to wall 92. FIG. 8 is a side elevation view showing the heads of screws 96 bearing against Z-girt 72 to retain Z-girt 72 and spacer 50 against wall 92.

Figure 9:
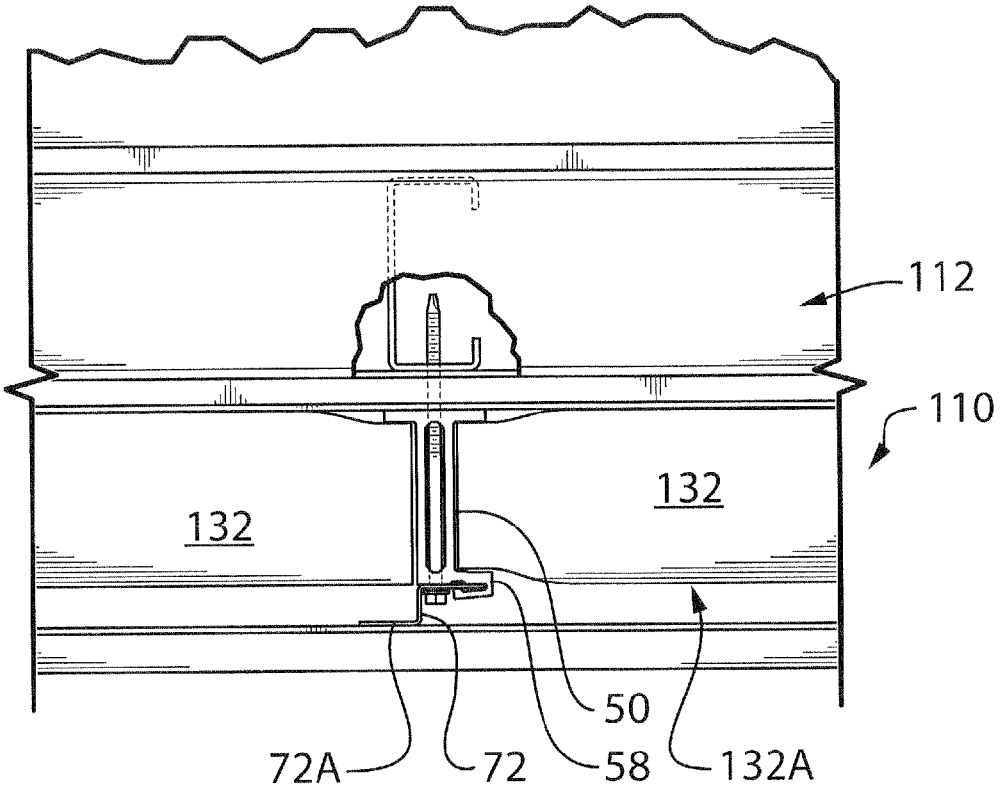
FIG. 9 is a top plan view of a wall assembly according to an example embodiment.
Figure 10:
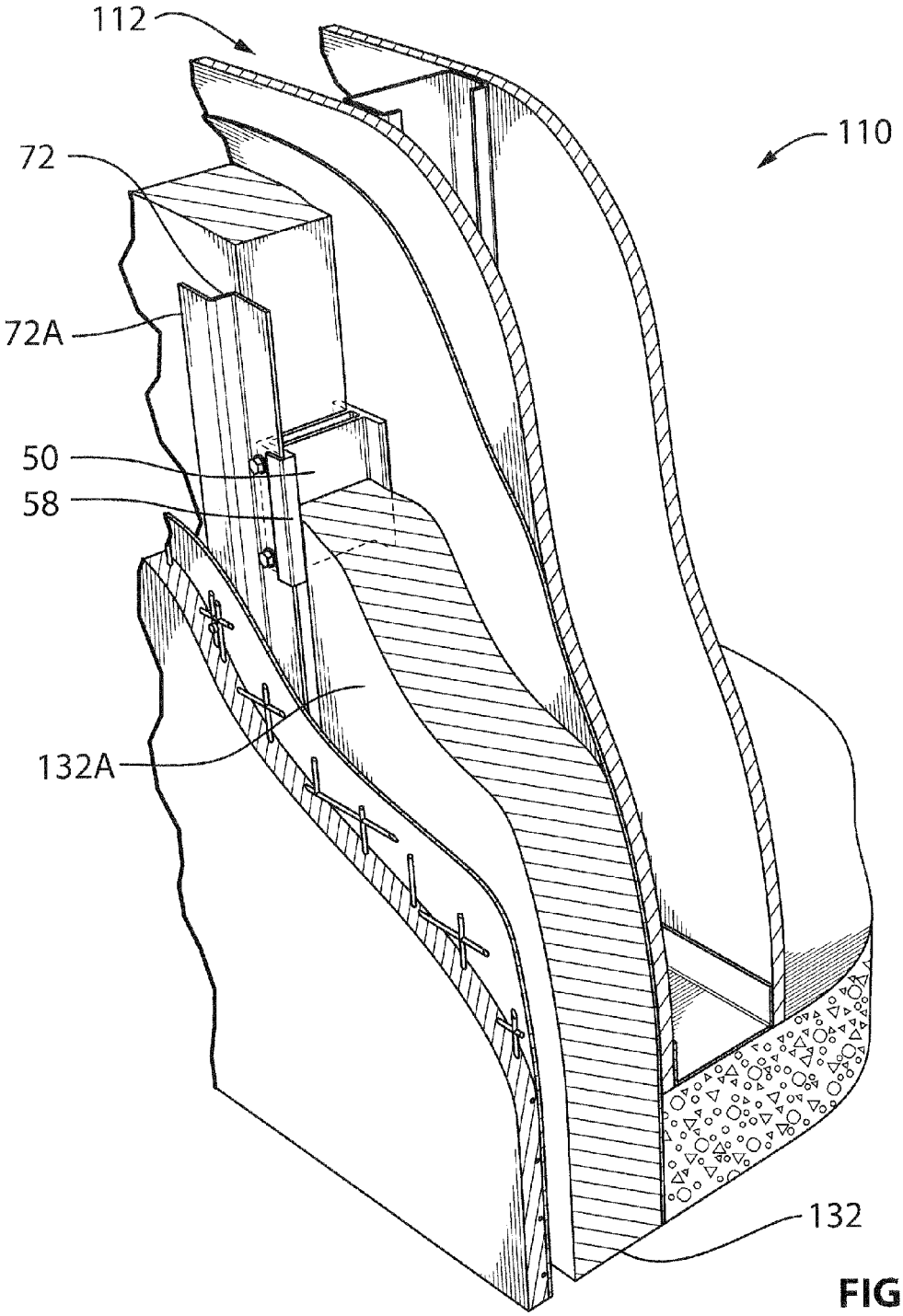
FIG. 10 a cutaway perspective view of the wall assembly shown in FIG. 9.

FIGS. 9 and 10 are, respectively, top plan and perspective views of a wall assembly 110 incorporating spacer 50. Assembly 110 is generally similar to assembly 10. The reference numerals used to identify components of assembly 10 are prefaced with the numeral '1' to identify like components of assembly 110 in FIG. 10, and are not described again. It can be seen that in the illustrated embodiment, guide 58 of spacer 50 abuts an outer face 132A of insulation 132, thereby retaining the proximate side of insulation 132 against wall 112. It may also be seen that flange 72A of Z-girt 72, though not shown in abutment with insulation 132, may act to retain a proximate side of insulation 132 against wall 112.

Thermal simulations performed at the direction of the inventors have shown that the thermal insulation performance of wall assembly 110 is significantly improved over assembly 10. Table II is a summary of effective R-values estimates determined by thermal simulations for walls constructed in the manner of assembly 110 having various depths of insulation 132 and correspondingly dimensioned spacers 50 having length of 6". The simulations whose results are summarized in Table II were performed using the same parameters as the simulations whose results are summarized in Table I.

TABLE II

| Thermal performance of wall assembly 110 | |
|---|---|
| Mineral Fiber Insulation Thickness | Overall Effective Insulation R-value |
| 3½ inches | 14.7 |
| 4 inches | 16.4 |

Figure 11:
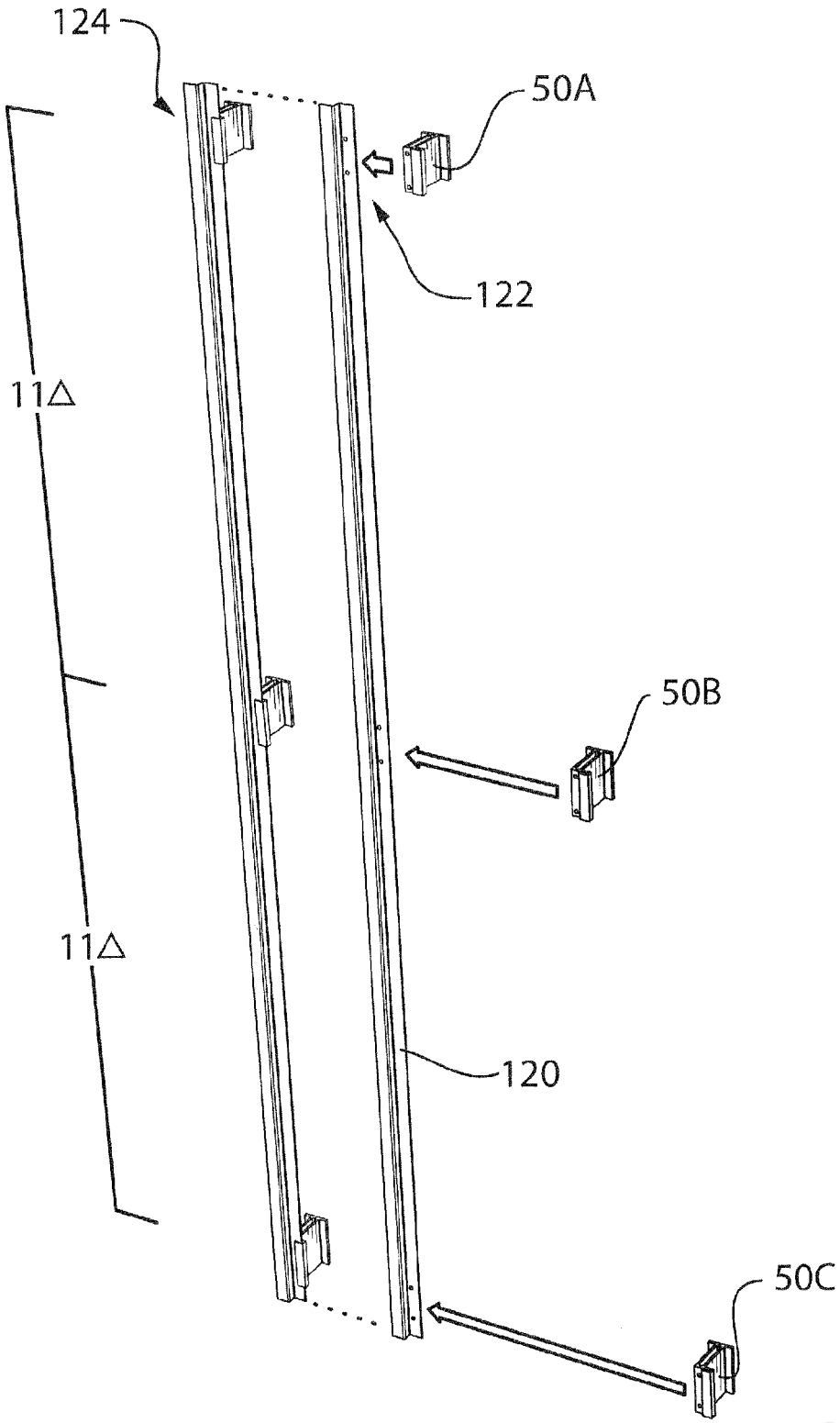
FIG. 11 is a graphic illustration of an example method for constructing a spacer and cladding component assembly according to an example embodiment.

FIG. 11 graphically illustrates an advantage provided by the ability of spacer 50 to retain cladding components. FIG. 11 shows how three spacers 50A, 50B and 50C (referred to collectively herein as spacers 50) may be clipped to a Z-girt 120. Z-girt 120 has a plurality of holes 122. By registering the apertures of spacers 50 with corresponding holes 122 in Z-girt 120, spacers 50 may be located appropriately on Z-girt 120 without measuring. Holes 122 may be pre-drilled in Z-girt 120 to streamline the installation of girt 120. Holes 122 may provide center-to-center spacing between adjacent spacers 50 (marked as 11Δ on assembly 124) that is less than 16", between 16" and 32", between 22" and 26", about 24", or more than 32", for example.

Once spacers 50 are clipped to Z-girt 120, the assembly 124 formed thereby may be positioned on a wall, and then secured to the wall by driving fasteners into the wall through Z-girt 120 and spacers 50. It may be convenient to hang assembly 124 by securing uppermost spacer 50A to a wall first, and then securing the lower spacers 50B and 50C to the wall. Because spacer 50A may be fastened to a wall using a plurality of fasteners that are co-linear with the longitudinal axis of Z-girt 120 (i.e., fasteners that pass through holes 122, which are co-linear with the longitudinal axis of Z-girt 120), assembly 122 may be hung in a desired alignment (e.g., vertically) by securing just spacer 50A.

Figure 12:
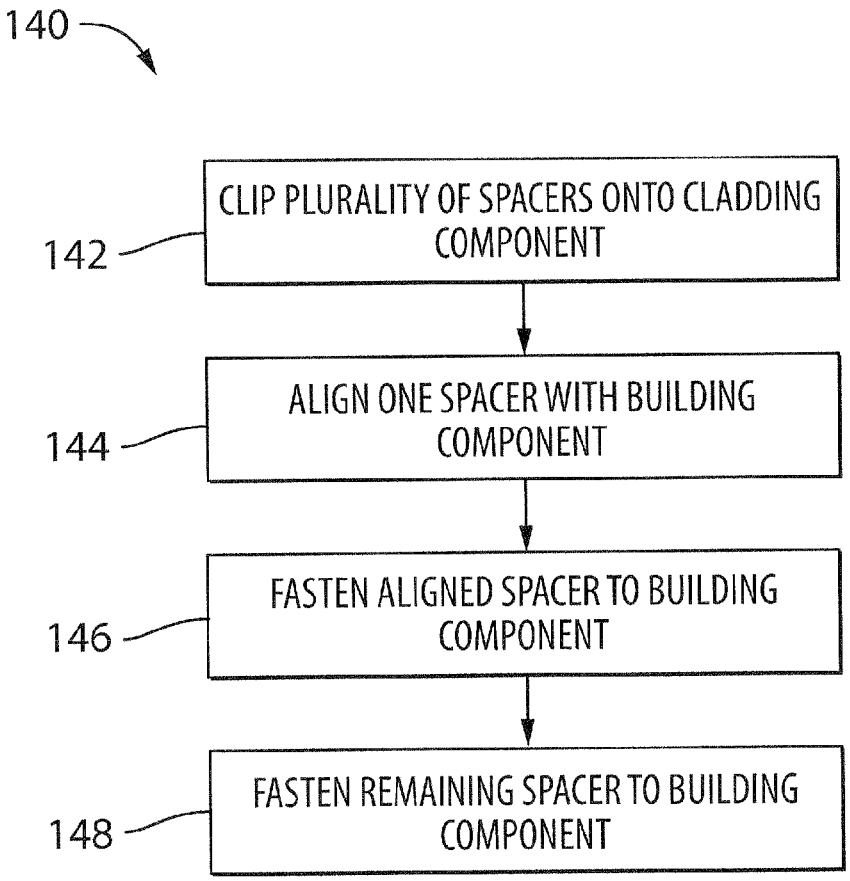
FIG. 12 is a flowchart of a method for spacing a cladding component to a building component according to an example embodiment.

It is thus apparent that the technology described herein enables methods for securing a cladding component to a building component. FIG. 12 is a flowchart of a method 140 according to an example embodiment. Step 142 of method 140 comprises clipping a plurality of spacers onto a cladding component. In step 142, spacers may be clipped onto the building component at spaced apart locations. In some embodiments, step 142 comprises clipping spacers that have apertures defined through them onto a cladding component such that the apertures defined through the spacers register with corresponding apertures defined through the cladding component. In some embodiments, step 142 comprises one or more of the steps and/or actions shown in FIGS. 5A, 5B and 5C and described herein. For example, clipping a plurality of spacers onto a cladding component may comprise deforming each of the plurality of spacers to accommodate and retain by restorative bias force a corresponding plurality of portions of the cladding component, for example.

Step 144 comprises aligning one of the spacers clipped to the cladding component with a building component. Step 144 may comprise aligning a spacer located at an end of a cladding component with a building component such as stud, for example. Step 144 may comprise aligning the spacer with the building component such that the other spacer(s) clipped to the building component are below the spacer being aligned. In step 134, one spacer may be aligned so that the other spacer(s) clipped to the cladding component are aligned with the building component.

Step 146 comprises fastening the spacer aligned in step 144 to the building component. Step 146 may also comprise fastening a portion of the cladding component to the building component. In some embodiments, step 146 comprises fastening the spacer aligned in step 144 and the cladding component to the building component at the same time, such as is shown in FIGS. 9 and 10, for example. Where in step 144 a spacer is aligned with the building component such that the other spacer(s) clipped to the cladding component are below the spacer that is aligned, step 146 may comprise hanging the cladding component and the other spacer(s) clipped thereto from the spacer fastened to the building component.

Step 148 comprises fastening the other spacer(s) clipped to the cladding component to the building component. In some embodiments, the cladding component is fastened to the building component at the same time that the spacers are fastened to the building component, such as is shown in FIGS. 9 and 10, for example.

Figure 13:
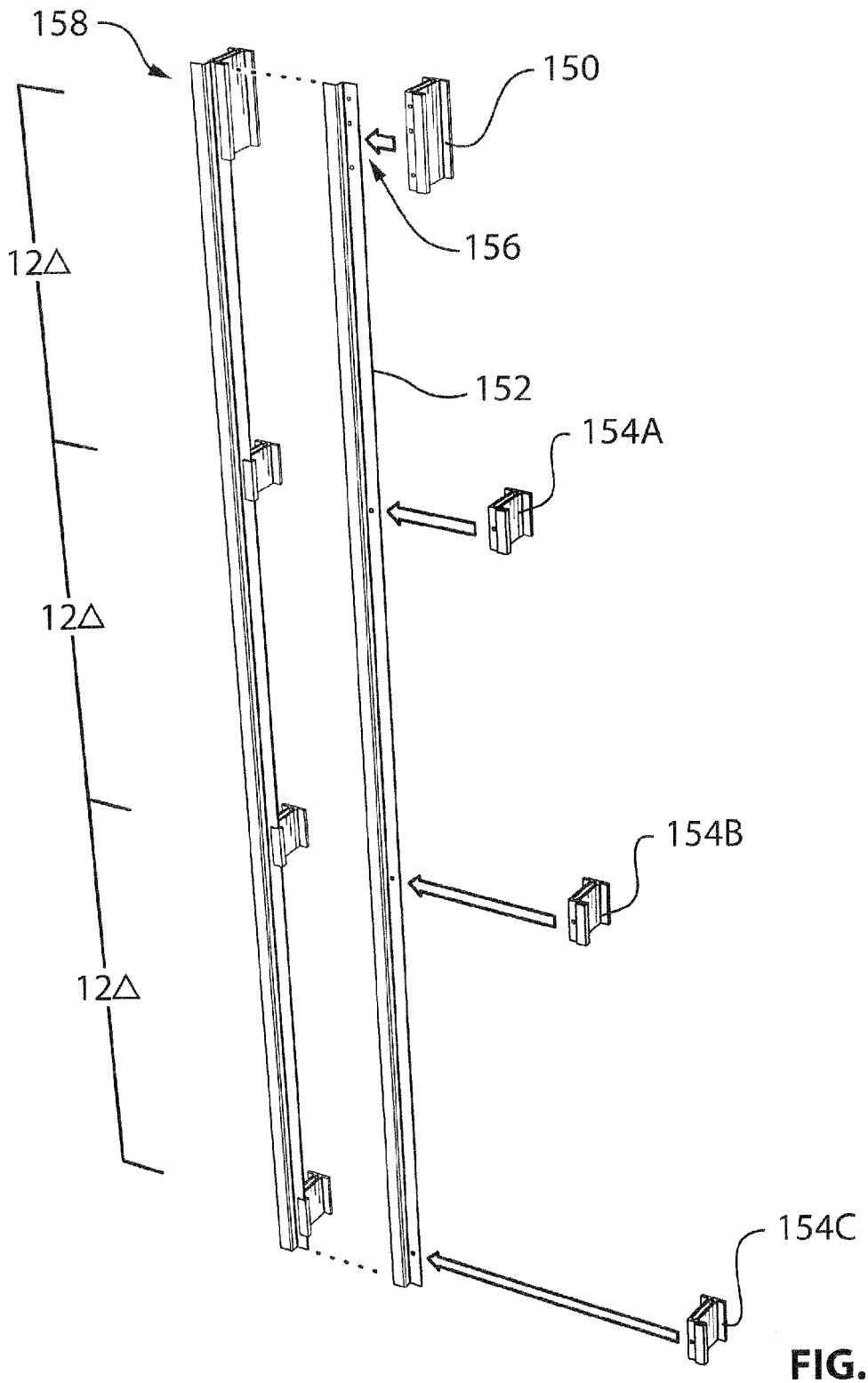
FIG. 13 is a graphic illustration of an example method for constructing a spacer and cladding component assembly according to an example embodiment.
Figure 14:
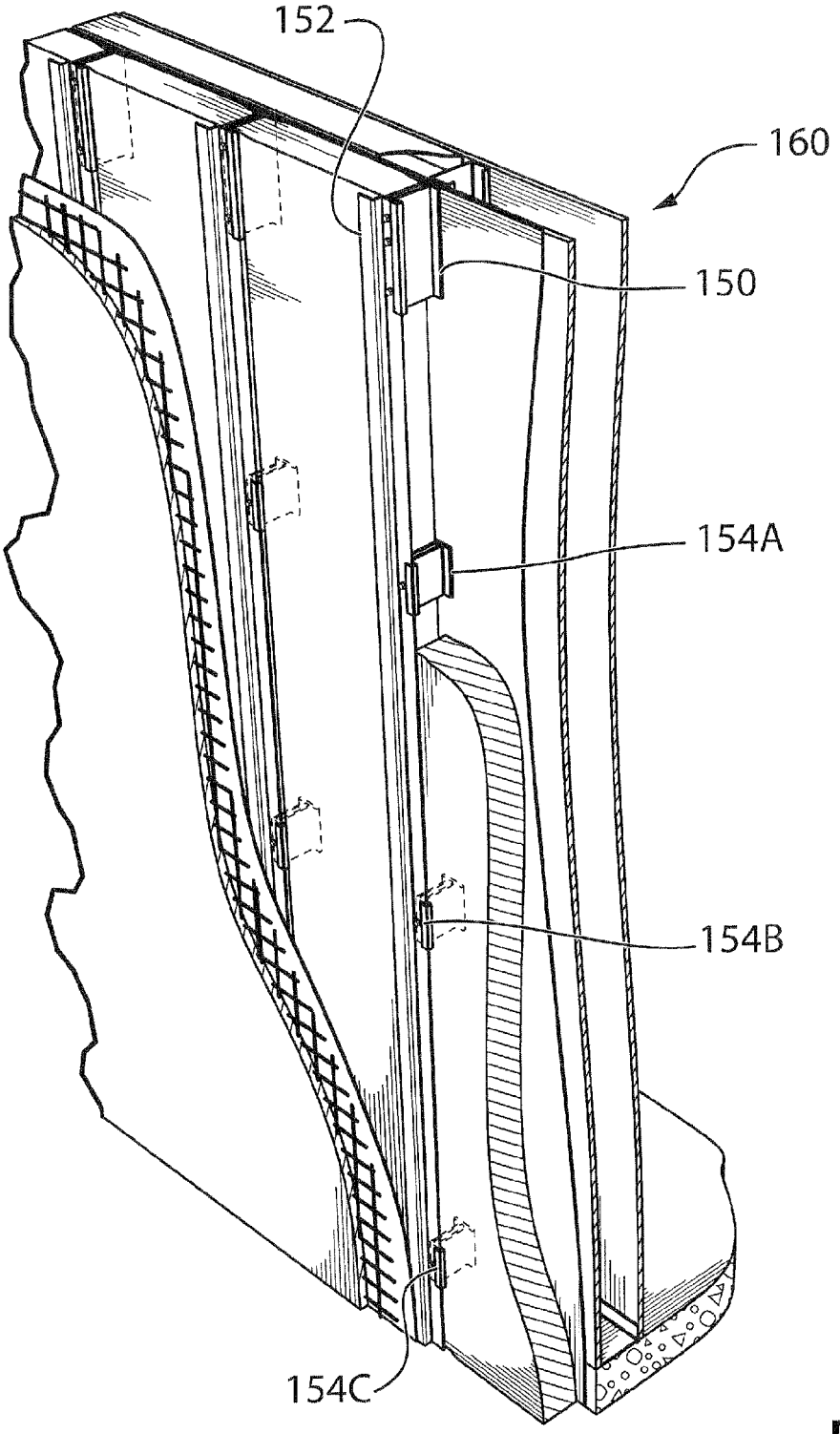
FIG. 14 is a cutaway perspective view of a wall assembly incorporating the assembly shown in FIG. 13.

FIGS. 13 and 14 illustrate an alternative embodiment comprising differently configured spacers. In FIG. 13 a first longer spacer 150 is clipped to a first end of a Z-girt 152, and three shorter spacers 154A, 154B and 154C (collectively referred to herein as spacers 154) are clipped along the remainder of Z-girt 152. Spacers 150 and 154 have uniform cross-section, which is the same as the cross section of spacer 50. Spacers 150 and 154 clipped to girt 152 provide assembly 158. FIG. 14 shows a cutaway perspective view of a wall assembly 160 comprising assembly 158.

Spacer 150 has three fastener paths defined though it in generally the same manner as fastener paths 80 are defined through spacer 50. In spacer 150, adjacent first and second ones of the fasteners paths are more closely spaced than the adjacent second and third ones of the fastener paths. Spacers 154 each have one fastener path defined though them in generally the same manner as fastener paths 80 are defined through spacer 50. The fastener paths defined through spacer 154 are centered at approximately the centers of their respective support members and bases.

Z-girt 152 has holes 156 that provide appropriate separation between spacers 150 and 154. Center-to-center spacing 12A between adjacent spacers 150 and 154 (marked on assembly 158) may be less than 16", between 16" and 32", between 22" and 26", about 24" or more than 32", for example.

In a non-limiting example embodiment, spacer 150 is 6" long and spacers 154 are 2" long. Where spacer 150 is relatively longer, it will be able to support relatively greater gravitational loads (e.g., a longer Z-girt 152 and a greater number of inferiorly located spacers 154). Where spacer 150 provides greater support for gravitational loads, spacers 154 need provide correspondingly less support, and may be made shorter. In some cases, the primary function of spacers 154 is to provide support against lateral (including forces perpendicular to the wall plane) forces acting on cladding connected to them.

Figure 15:
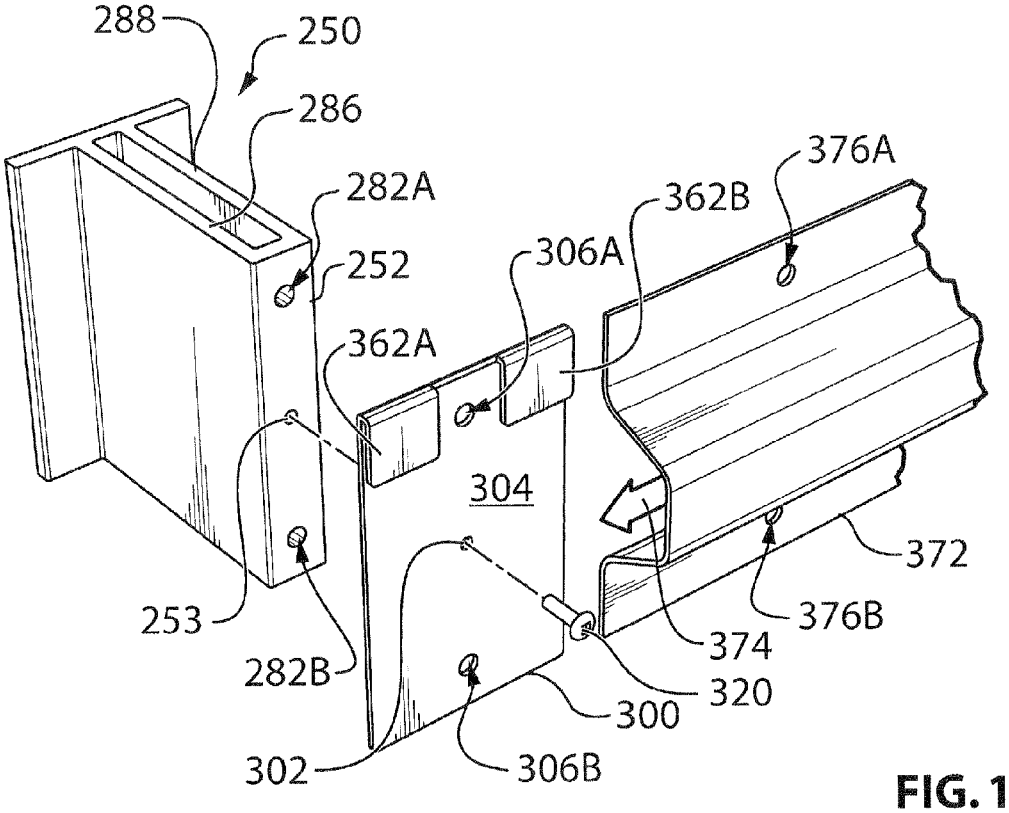
FIG. 15 is a perspective view of a spacer according to an example embodiment.

FIG. 15 is a perspective view of a spacer 250 according to an example embodiment and a guide 300 according to an example embodiment. Spacer 250 and guide 300 may be used together to space a cladding component from a building component. Spacer 250 is generally similar to spacer 50. The reference numerals used to identify feature of spacer 50 are prefaced with the numeral '2' to identify like components of spacer 250 in FIG. 15, and are not described in detail again.

Spacer 250 differs from spacer 50 in that it does not have a guide adjacent to support member 252 for locating a cladding component on support member 252. Instead, guide 300 is configured to be mounted on support member 252. Guide 300 is configured to locate a cladding component relative to support member 252. It may be observed from FIGS. 15 and 16 that spacer 250 has uniform cross section. In some embodiments, spacer 250 comprises a pultruded profile section of a fibre reinforced polymer, such as fibreglass, for example.

To facilitate mounting guide 300, an aperture 253 is defined through support member 252. A corresponding aperture 302 defined through body 304 of guide 300 may be registered with aperture 253 of support member 252 to align guide 300 with support member 252. A locating member, such as headed screw 320 (a penetrating fastener), for example, may inserted into registered apertures 253 and 302 to maintain an alignment of guide 300 with support member 252.

In some embodiments, alignment of guide 300 and support member 252 is facilitated in other ways. For example, guide 300 may comprise a bracket configured to engage the support member 252 between walls 286 and 288. In some embodiments, guide 300 comprises a bracket configured to engage support member 252 along one of its short sides between walls 286 and 288. In some embodiments, guide 300 comprises a tab that extends from one of its sides and is manually deformable to form such a bracket. Guides and tabs of this sort may be provided on opposed sides of guide 300.

A pair of apertures 306A and 306B are defined through body 304 of guide 300. Apertures 306A and 306B may be simultaneously registered with apertures 282A and 282B, respectively, of support member 252. Where this is done, fastener paths 280A and 280B of spacer 250 extend through apertures 306A and 306B.

Guide 300 comprises a pair of flanges 362A and 362B (referred to collectively herein as flanges 362). Flanges 362 are parallel and spaced apart from body 304. In the illustrated embodiment, flanges 362 are integral with body 304. More particularly, flanges 362A and 362B comprise spaced apart tabs extending from a side of body 304 that have been folded over body 304. Flanges 362A and 362B are located on opposite sides of aperture 306A.

Figure 16:
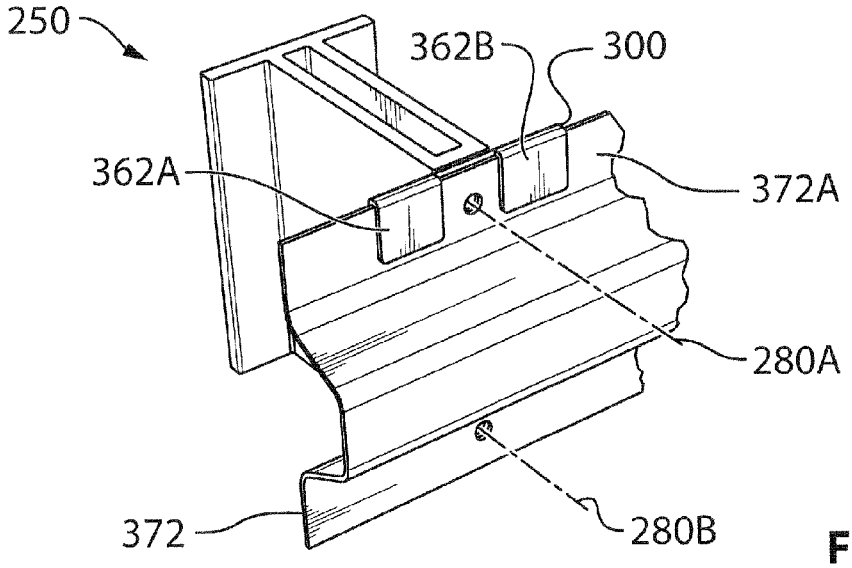
FIG. 16 is a perspective view of a spacer, guide and cladding component assembly according to an example embodiment.

As shown in FIGS. 15 and 16, guide 300 is configured to locate a cladding component, namely hat channel 372 over support member 252. Hat channel 372 may be inserted between flanges 362 and body 304 in the direction indicated by arrow 374. In some embodiments, hat channel 372 may also be inserted between flanges 362 and body 304 in the direction across body 304 toward the side of guide 300 where flanges 362 meet body 304. Flanges 362 provide a stop which may be used to locate hat channel 372 over support member 252. In the illustrated embodiment, the stop provided by flanges 362 is located along the edge of body 304 from which flanges 362 extend. The stop provided by flanges 362 is perpendicular to the long sides of support member 252. Where spacer 250 comprises a pultruded profile section, flanges 362 are perpendicular to the pultrusion axis of spacer 250.

Guide 300 may be configured to retain a cladding component. In the illustrated embodiment, flanges 362 are nominally spaced apart from body 304 by slightly less than the thickness of portion 372A of hat channel 372, and are resiliently displaceable from their nominal position relative to body 304. Inserting portion 372A of hat channel 372 between body 304 and flanges 362 causes flanges 362 to be displaced away from body 304. Thus displaced from their nominal positions, flanges 362 are biased by restorative deformation forces to retain hat channel 372 against body 304. In some embodiments, additional flanges are provided on the side of body 304 opposite to the side from which flanges 362 extend. For example, a second pair of flanges may be provided opposite flanges 362.

A pair of apertures 376A and 376B are defined through hat channel 372. Apertures 376A and 376B may be one pair of a plurality of pairs of apertures defined through hat channel 372 along its length. Apertures 376A and 376B may be simultaneously registered with apertures 282A and 282B, respectively of support member 252 and with apertures 306A and 306B, respectively, of guide 300. Where this is done, fastener paths 280A and 280B of spacer 250 extend through apertures 376A and 376B. Penetrating fasteners may be inserted through apertures 376A and 376B, through apertures 306A and 306B and through apertures 282A and 282B along fastener paths 280A and 280B into a building component to secure spacer 250, guide 300 and hat channel 372 to the building component.

It will be appreciated that a plurality of guides 300 may be attached to a corresponding plurality of spacers 250, the assembled guides 300 and spacer 250 clipped to hat channel 372. In some embodiments, a plurality of guides 300 may be clipped to hat channel 372 before the guides 300 are mated with corresponding spacers 250.

Advantageously, the combination of spacer 250 and guide 300 permits an elongate cladding component to be supported in a horizontal orientation while walls 286 and 288 are oriented vertically, so that the force of gravity on the cladding component manifests as shear stress in walls 286 and 288. In some embodiments, hat track 272 has apertures 376A and 376B located at approximately the center of its length, and a single spacer 250 is sufficiently strong to support hat track 272. In such embodiments, hat track 272 may be secured to a building component according to a variant of method 140 in which a centrally located spacer 250 and guide 300 is the first-fastened spacer.

Where a component is referred to above (e.g., a spacer, support member, base, contact surface, web, guide, flexural member, flexure bearing, flange, projection, recess, wall, aperture, fastener path, fastener, cladding component, etc.), unless otherwise indicated, reference to that component (including a reference to a "means") should be interpreted as including as equivalents of that component any component which performs the function of the described component (i.e., that is functionally equivalent), including components which are not structurally equivalent to the disclosed structure which performs the function in the illustrated exemplary embodiments of the invention.

Unless the context clearly requires otherwise, throughout the description and the claims, the words "comprise," "comprising," and the like are to be construed in an inclusive sense, as opposed to an exclusive or exhaustive sense; that is to say, in the sense of "including, but not limited to." Where the context permits, words in the above description using the singular or plural number may also include the plural or singular number respectively. The word "or," in reference to a list of two or more items, covers all of the following interpretations of the word: any of the items in the list, all of the items in the list, and any combination of the items in the list.

The above detailed description of example embodiments is not intended to be exhaustive or to limit this disclosure and claims to the precise forms disclosed above. While specific examples of, and examples for, embodiments are described above for illustrative purposes, various equivalent modifications are possible within the scope of the technology, as those skilled in the relevant art will recognize.

These and other changes can be made to the apparatus in light of the above description. While the above description describes certain examples of the technology, and describes the best mode contemplated, no matter how detailed the above appears in text, the technology can be practiced in many ways. As noted above, particular terminology used when describing certain features or aspects of the apparatus should not be taken to imply that the terminology is being redefined herein to be restricted to any specific characteristics, features, or aspects of the system with which that terminology is associated. In general, the terms used in the following claims should not be construed to limit the system to the specific examples disclosed in the specification, unless the above description section explicitly and restrictively defines such terms. Accordingly, the actual scope of the technology encompasses not only the disclosed examples, but also all equivalent ways of practicing or implementing the technology under the claims.

From the foregoing, it will be appreciated that specific examples of apparatus have been described herein for purposes of illustration, but that various modifications, alterations, additions and permutations may be made without departing from the practice of the invention. The embodiments described herein are only examples. Those skilled in the art will appreciate that certain features of embodiments described herein may be used in combination with features of other embodiments described herein, and that embodiments described herein may be practiced or implemented without all of the features ascribed to them herein. Such variations on described embodiments that would be apparent to the skilled addressee, including variations comprising mixing and matching of features from different embodiments, are within the scope of this invention.

As will be apparent to those skilled in the art in light of the foregoing disclosure, many alterations and modifications are possible in the practice of this invention without departing from the spirit or scope thereof. For example:

- Spacers according to embodiments of the invention may be used to space and secure cladding components (including insulation) other than those specifically shown and described herein. For example, spacers according to embodiments of the invention may be used to space Z-girts, C-channel girts, J girts, hat tracks, purlins and the like.
- Spacers according to embodiments of the invention formed by pultrusion or like processes which result in uniform cross sections may subsequently modified to have non-uniform cross sections. For instance, corners of spacers may be bevelled or rounded.
- Spacer that lack integral guides (such as spacer 250, for example) may comprise features for cooperating with corresponding features of externally provided guides (such as guide 300, for example). Such cooperating features may enable spacers and guides to be located and/or joined without other components (e.g., locating members, fasteners). For example, cooperating features on spacers and guides may provide snap fit engagement between spacers and guides.
- Spacers may comprise features for retaining cladding components that are different in structure or manner of function than flexural member 60.
- Spacers need not be shorter than the length of the cladding components they space and/or secure. For example, a spacer be the same length, or be longer than, a girt it spaces and/or secures.

The plastic matrix of spacers from fibreglass may comprise epoxy, thermosetting plastic, thermoplastic, combinations thereof or the like.

Spacers may be made from materials other than fibreglass. For example, in some embodiments, spacers are made from other fibre-reinforced polymers, such as polyamides. Other possible materials with low conductivity characteristics which could be employed are Aerogel, polystyrene, cork, polypropylene, PVC, ABS, polycarbonate, polyamide/nylon, neoprene, and acrylic/plexiglass.

While a number of exemplary aspects and embodiments have been discussed above, those of skill in the art will recognize certain modifications, permutations, additions and sub-combinations thereof. It is therefore intended that the following appended claims and claims hereafter introduced are interpreted to include all such modifications, permutations, additions and sub-combinations as are within their true spirit and scope.

What is claimed is:

1. A spacer for use in spacing a cladding component from a building component, the spacer comprising:

a support member;

a base spaced apart from the support member, the base having a contact surface facing away from the support member, and the support member having a support surface facing away from the base;

a web extending between the support member and the base; and a resiliently displaceable clip provided on the support surface of the support member and configured to retain the cladding component on the support member;

the resiliently displaceable clip comprising a flange configured to retain the cladding component against the support member on the support surface, at least a portion of the flange being resiliently displaceable away from the support member, the resiliently displaceable portion of the flange comprising a projection, the support member comprising a recess on the support surface, the recess being positioned opposite to and spanning the projection.

2. The spacer of claim 1 wherein the spacer comprises a fibre reinforced polymer.

3. The spacer of claim 2 wherein the spacer comprises fibreglass.

4. The spacer of claim 1 wherein the support member, base, web and resiliently displaceable clip are features of a pultruded profile section.

5. The spacer of claim 4 wherein the support member is elongate, and wherein the resiliently displaceable clip provides a stop parallel to one of the long sides of the support member.

6. The spacer of claim 1 wherein the resiliently displaceable portion of the flange is resiliently displaceable away from the support member in a direction generally normal to the support member.

7. The spacer of claim 6 wherein the resiliently displaceable clip comprises a flexure bearing connected to the flange, the flexure bearing allowing the resiliently displaceable portion of the flange to be resiliently displaced away from the support member.

8. The spacer of claim 7 wherein the resiliently displaceable clip comprises a U-shaped flexural member adjacent to the support member, the U-shaped flexural member comprising the flange and the flexure bearing.

9. The spacer of claim 1 wherein the support member comprises an aperture defined through it.

10. The spacer of claim 9 wherein the resiliently displaceable clip is configured to locate the cladding component over the aperture defined through the support member.

11. The spacer of claim 10 wherein the base has an aperture defined through it, and when the contact surface abuts the building component, the apertures defined in the base and the support member define a fastener path normal to the building component.

12. The spacer of claim 1 wherein the spacer is comprised of a low thermal conductivity material.

13. The spacer of claim 1 wherein the at least a portion of the flange that is resiliently displaceable away from the support member comprises a free end of the flange.

14. The spacer of claim 13 wherein one or both of an inward edge and an outward edge of the recess are smoothly beveled.

15. An assembly for use in spacing a building component and a cladding component, the assembly comprising:

a spacer having:

an elongate support member, a base spaced apart from the support member, the base having a contact surface facing away from the support member, and a web connected between the support member and the base; and a resiliently displaceable clip adjacent the support member of the spacer, the resiliently displaceable clip configured to retain the cladding component relative to the spacer and to provide a stop perpendicular to one of the long sides of the support member, the resiliently displaceable clip comprising:

a body generally parallel to the support member, and a flange spaced apart from the body, wherein the flange comprises a tab extending from the body and folded over the body along a fold perpendicular to one of the long sides of the support member, wherein the support member, base and web and are features of a pultruded profile section.

* * * * *